United States Patent [19]

Lynch

[11] Patent Number: 4,986,697

[45] Date of Patent: Jan. 22, 1991

[54] MARINE PIPELINE TRENCHING PLOW FOR SIMULTANEOUS PIPE LAYING AND ENTRENCHMENT

[75] Inventor: Robert P. Lynch, Tulsa, Okla.

[73] Assignee: Lyntech Corporation, Tulsa, Okla.

[21] Appl. No.: 299,045

[22] Filed: Jan. 19, 1989

Related U.S. Application Data

[63] Continuation-in-part of Ser. No. 8,277, Jan. 28, 1987, abandoned, which is a continuation of Ser. No. 608,076, May 7, 1984, abandoned.

[51] Int. Cl.[5] ..... F16L 1/04

[52] U.S. Cl. ..... 405/165; 405/158; 405/163

[58] Field of Search ..... 405/258, 164, 165, 163, 405/174, 176, 175, 177, 160; 37/98, 8 A, 274, 266

[56] References Cited

U.S. PATENT DOCUMENTS

| | | | |
|---|---|---|---|
| 3,347,054 | 10/1967 | Sherrod | 405/164 |
| 3,462,963 | 8/1969 | Moore | 405/164 |
| 3,877,237 | 4/1975 | Norman | 405/160 |
| 3,952,532 | 4/1976 | Spearman | 405/164 |
| 4,053,998 | 10/1977 | Ezoe | 405/159 X |
| 4,245,927 | 1/1981 | Wharton | 405/163 |
| 4,330,225 | 5/1982 | Glasgow | 405/160 |
| 4,338,042 | 7/1982 | Faldi | 405/161 |
| 4,410,297 | 10/1983 | Lynch | 405/164 |
| 4,744,696 | 5/1988 | Vidler | 405/174 X |

*Primary Examiner*—Dennis L. Taylor

[57] ABSTRACT

A method and apparatus for simultaneously digging a trench in the bottom of a body of water and laying a pipe from a barge therein. The plow is provided with vertical side plates to assist in molding the side of the cut trench so an inclined ramp can move the soil upwardly where it is diverted to each side of the trench. The pipe being laid is extended from a working barge through a hiatus at the aft end of the trenching device. The position of the pipe in the hiatus is monitored and that information is used to properly position the barge with respect to the trenching machine. In one embodiment a gas/oil spring supports the lower horizontal roller at the bottom of the hiatus.

15 Claims, 15 Drawing Sheets

MARINE PIPELINE TRENCHING PLOW FOR SIMULTANEOUS PIPE LAYING AND ENTRENCHMENT

CROSS REFERENCE TO RELATED APPLICATIONS

This application is a continuation-in-part of application Ser. No. 07/008,277, filed 1-28-87 for Marine Pipeline Trenching Plow For Simultaneous Pipe Laying And Entrenchment, now abandoned which is a continuation of application Ser. No. 608,076, filed May 7, 1984 now abandoned.

BACKGROUND OF THE INVENTION

1. Field of the Invention:

This invention relates to improvements in pipeline laying apparatus and more particularly, but not by way of limitation, to a marine trenching plow for excavating a pipeline trench in an underwater location while simultaneously laying the pipe in the dredge trench.

2. Description of the Prior Art:

It is common practice today to lay or bury marine pipelines on the floor of the ocean or other bodies of water to protect the pipeline from damage due to underwater currents, anchors, or other underwater hazards. The pipeline is normally carried on a lay barge and is wound onto and off of suitable reel means mounted on the barge whereby the pipeline is transferred to the ocean bottom. In addition, an underwater plow or trenching means is usually towed by the barge for dredging a pipeline receiving trench on the floor or bottom of the body of water. Conventional underwater trenching or marine dredging techniques frequently comprise the initial cutting of the trench on the floor of the ocean. Then later, the pipeline is laid in the open previously laid trench. Another common method of installing a pipeline underwater comprises the laying of the pipeline on the ocean floor and subsequently excavating a trench beneath the pipe by using a high pressure water jet sled. Many attempts at solving the problems involved in the laying of marine pipelines have been devised, as shown in the Schrom U.S. Pat. No. 3,401,473; Hale et al U.S. Pat. No. 3,333,432; Spearman U.S. Pat. No. 3,952,532; Suzuki et al U.S. Pat. No. 4,011,727; Carlsson et al U.S. Pat. No. 4,129,992; Ezoe et al U.S. Pat. No. 3,898,852; Shiroyama et al U.S. Pat. No. 3,824,789; Holberg U.S. Pat. No. 3,788,085; Sherrod U.S. Pat. No. 3,540,266; Sherrod U.S. Pat. No. 3,347,054; Moore U.S. Pat. No. 3,217,499; Lawton U.S. Pat. No. 2,142,136; Lawson et al U.S. Pat. No. 2,067,717; Change et al U.S. Pat. No. 4,112,695; Gunn U.S. Pat. No. 4,091,629; deBoer et al U.S. Pat. No. 4,037,422; Good et al U.S. Pat. No. 3,786,642; Tesson U.S. Pat. No. 3.372.461; Lang al U.S. Pat. No. 3,982,402; and the Uyeda et al U.S. Pat. No. 4,260,287. These devices have certain disadvantages, however, in that most of them require the laying of the pipe and the dredging of the trench therefor be accomplished in separate operations, which is both expensive and time consuming.

SUMMARY OF THE INVENTION

The present invention contemplates a novel combined pipe laying and trenching apparatus which has been particularly designed and constructed for overcoming the foregoing disadvantage. The novel device combines the laying of the pipeline and the dredging of a trench therefor in a single operation thus providing for both economy and reduction of time required in a marine pipeline laying or construction operation. In a preferred embodiment the novel device comprises a primary horizontal cutting element which is supported below the runners of the pipe support and pipe laying sled. The device has a primary horizontal cutting element which is supported by a flat, upright framing supported from an upper center module support of the underwater sled. The leading edge of these upright framing are provided with sharp cutting edges. In what is believed to be even a more preferred embodiment there is an upper horizontal cutting element which is supported a short distance above and in front of the primary horizontal cutting element. This secondary horizontal cutting element is also suported by vertical upright frame from the center module support of the structure. This primary cutting device is provided with a trailing curve ramp which elevates the cuttings upward from the bottom of the trench being dredged to the level of the floor of the body of water. A vertical side plate extends on each side of the ramp from the surface of the ramp up to the runners. The horizontal cutting element, the ramp and the side plates form what may be called a scoop. The plow has a rectangular profile so as to cut a trench with near vertical walls. The reason for this is to prevent the pipe from climbing out of the trench as the barge weaves along the right of way. Prior plows had a V-shaped trench profile and they have had serious problems with the pipe climbing out of the trench. The vertical side plates of the plow scoop firms up the sides of the dug trench in a somewhat trowel-like operation.

The cuttings, which are moved up the inclined ramp as the plow is moved along the body of water, is diverted or split by a V-shaped diverter means which directs the cuttings for discharge at a sufficiently great distance from the trench so as to substantially eliminate any of the cuttings or spoil falling back into the dredged trench.

The use of the primary horizontal cutting element permits that part of the module supporting it to be made stronger than the rest of the structure to the aft of it. This, of course, saves on weight and towing costs and construction costs.

In one embodiment the cutting elements or blades are pivotally secured to the support sled or skid means which slides over the surface of the ocean floor while being towed by the lay barge. Suitable actuators, such as hydraulic means, are provided for rotating the cutting module in the vertical direction, thus selectively elevating the cutting elements to a position above or out of engagement with the natural bottom of the ocean, thus allowing the entire apparatus to be towed through the ocean or body of water without cutting a trench.

In another embodiment, a depth regulating means is pivotally secured to the rear portion or trailing end of the rear or final cutting elements. The depth regulation means may be in the form of a pad which rides on the bottom of the dredged trench, and the angle of the regulating pad may be adjusted in relation to the bottom of the trench. The application of a downward force against the trench bottom by the regulating pad permits a control of the depth to which the trench is cut.

In the disclosed simultaneous trenching and pipe laying method the plow is mounted on a sled which is towed by a tow line extending from a barge. Also extending from the barge in my system is a pipeline which extends through the pipe laying apparatus which is being towed. This pipe will have what is called a "natural catenary", that is a specific curve from the barge to the point that the pipe contacts the bottom of the trench which is usually about 400 to 1,000 feet or so behind the pipe laying barge. As is well known, the pipe catenary is a function of the water depth, the mechanical properties of the pipe, and the tension applied to the pipe. For a given water depth, the pipe catenary profile is a constant. If this pipe is forced out of its precisely controlled catenary it will probably be severely damaged and expensive repair work will have to be done. Disclosed herein is a method and apparatus for preventing the distortion of the catenary of the pipeline being laid.

The pipeline extends through a hiatus or space at the rear of the trench laying portion of the sled. The hiatus can have what may be called a top, a bottom and two sides. A horizontal load and position sensing roller is positioned at the bottom of the hiatus and is provided with a load sensing means to detect the force thereon. Suitable indicator gauges are installed on the barge thus providing determination as to how much vertical force of the pipe is bearing on the horizontal roller. A top roller may be provided across the top of the hiatus and it too may be provided with load sensing means. This unique feature is considered critical to the operation of the novel combination pipeline laying and trenching apparatus since it is considered necessary that the apparatus be positioned in a precise range relative to the catenary curve of the pipeline during the laying operation in order to prevent damage to the pipe.

While the pipe catenary profile is a constant, the catenary of the tow wire which pulls the trenching and pipe laying apparatus is not a constant because applied force constantly changes as different types of soil are encountered during the trenching operation. The instrumented horizontal load and position sensing roller means gives the operator of the equipment a substantial instantaneous indication of the plow position relative to the pipe. If the pipe starts to place a heavy force on one of the rollers then corrective actions by changing the length of the towing line can be immediately taken. This facilitates immediate adjustment of the tow line length in order to prevent pipe damage. This novel combined pipe laying and trenching apparatus is simple and efficient in operation and is economical and durable in construction to prevent damage to the pipe.

In yet another embodiment the lower horizontal pipe load and position sensing roller is pivotally supported from the center module of the plow support frame by a gas spring support. The pressure on the gas indicates the position of the pipe being laid.

It is one object of this invention to provide a novel plow for an underwater trenching machine for cutting substantially vertical sides of the dug trench.

It is another object to provide a method and apparatus wherein the position of the pipe catenary and the trenching machine are controlled.

DETAILED DESCRIPTION OF THE PREFERRED EMBODIMENT

Figure 1:
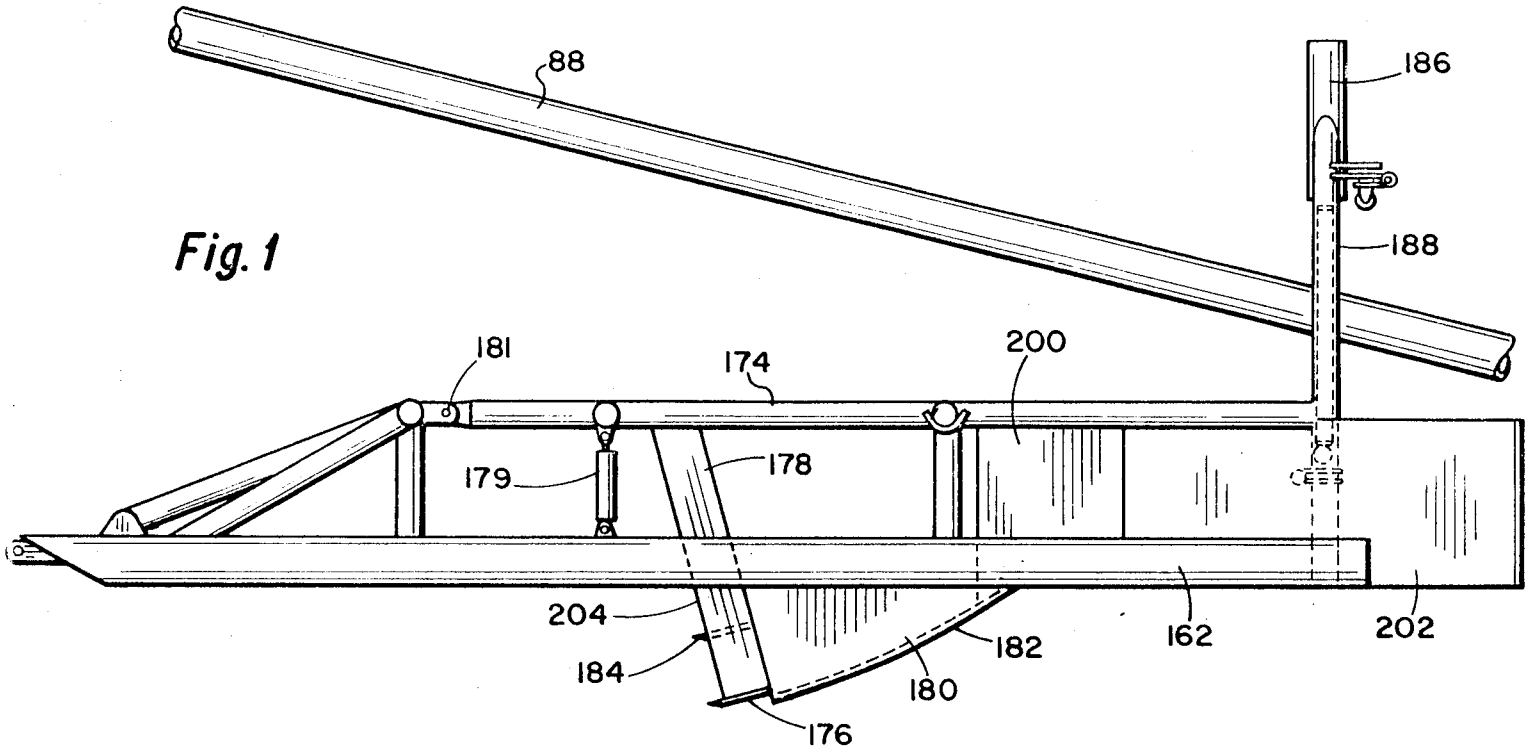
FIG. 1 is a side elevation view of a combined trenching and pipe laying apparatus illustrating the preferred embodiment of the invention.
Figure 2:
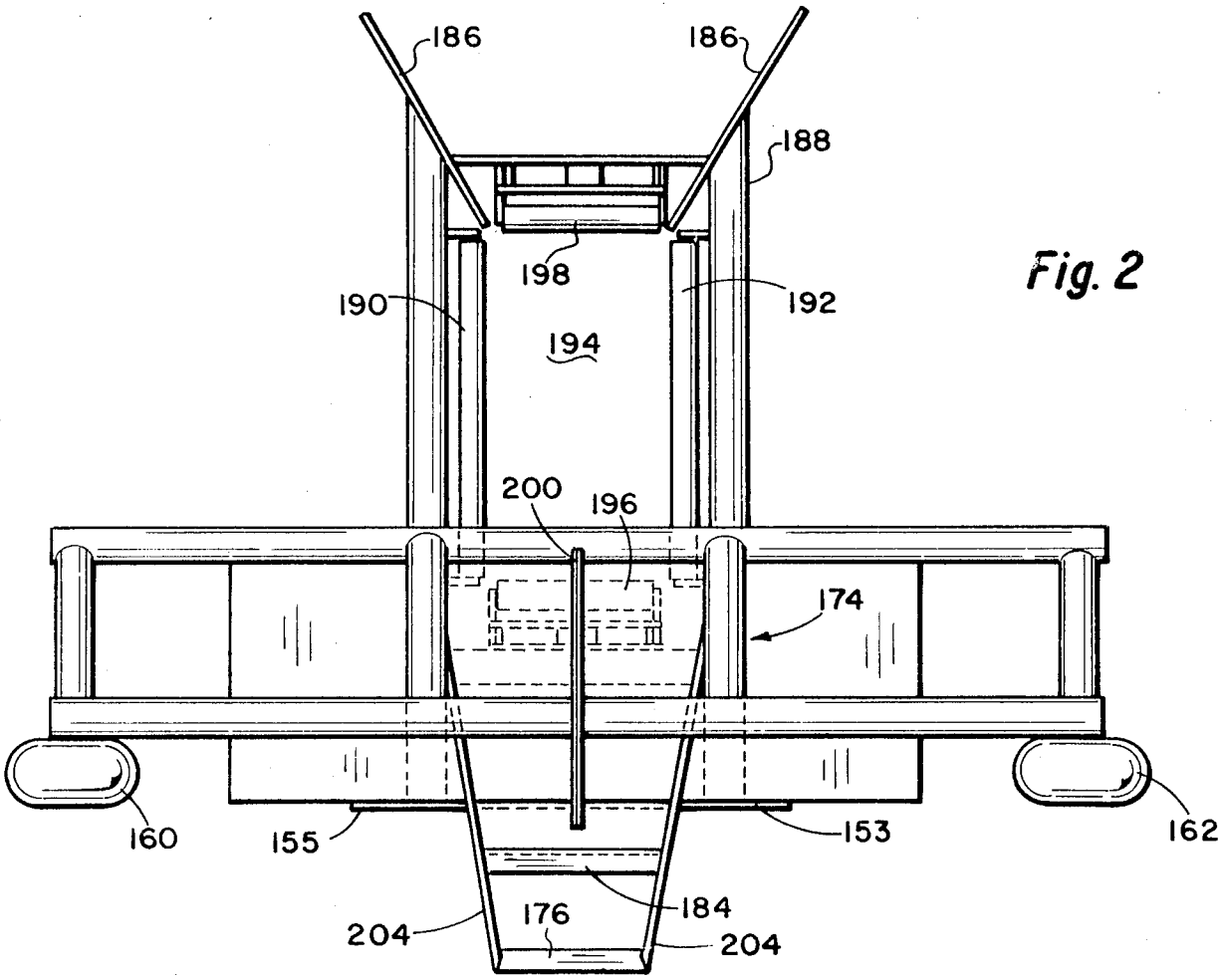
FIG. 2 shows a front view of the embodiment of FIG. 1 without the pipe.
Figure 3:
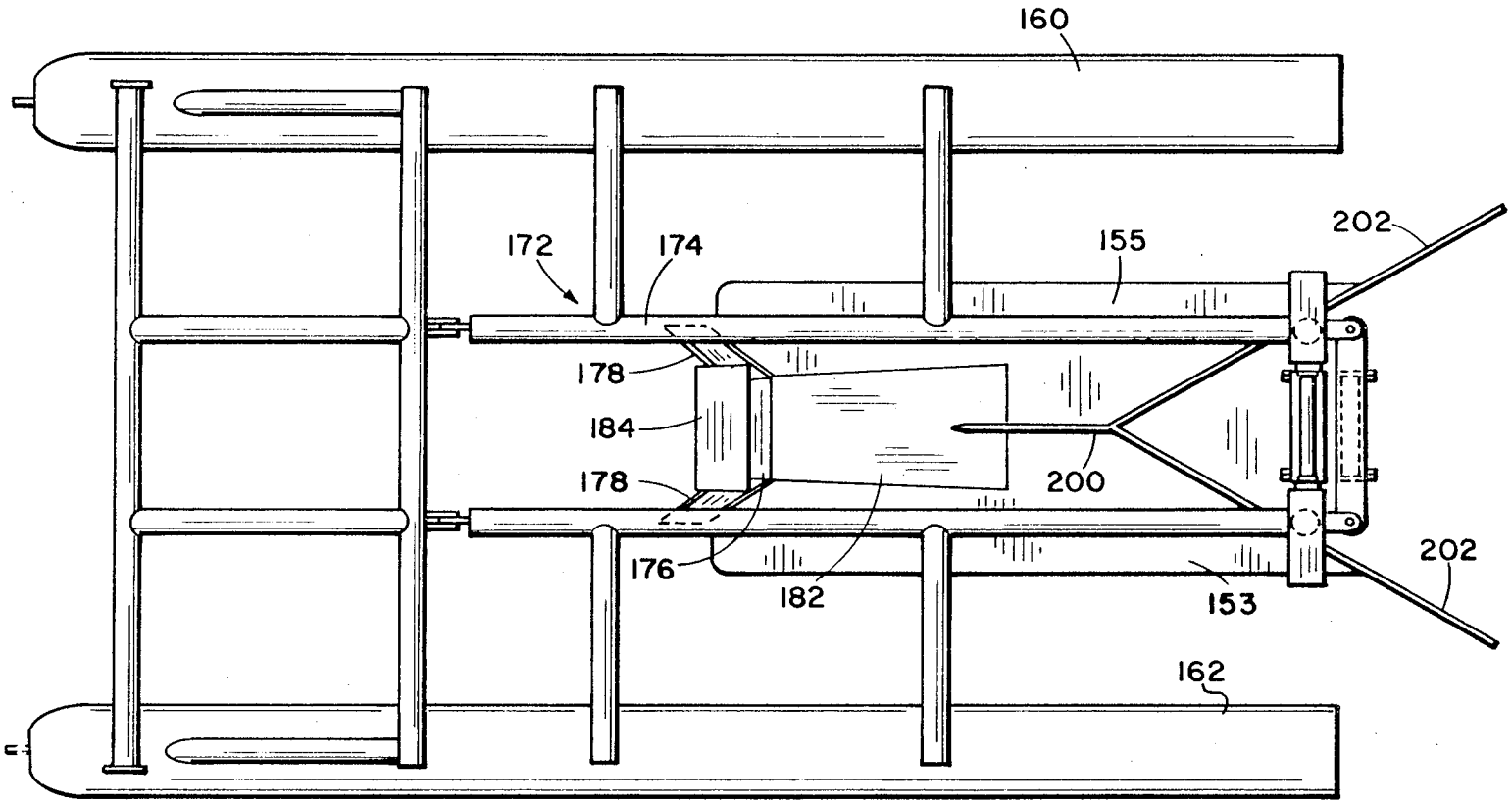
FIG. 3 is a top view of the embodiment shown in FIG. 1 with the pipe removed.

Attention is first directed to FIGS. 1, 2 and 3 which shows a preferred embodiment of the plowing system. Shown thereon is a first runner 160 and a second runner 162 with structural framing 172 for supporting plow frame support center module support 174. Shown thereon is also a primary horizontal cutting element 176 which is supported by upright framing member 178 supported from the plow support structure 174. Side plates 180 extend backwards or aft from the primary horizontal cutting element 176. A soil elevating ramp 182 extends between the two side plates 180. This forms a scoop-like plow. A strengthening member 184 which may be a second plow or secondary horizontal cutting element is positioned between members 178. The secondary horizontal cutting element 184 is slightly to the front of primary horizontal cutting element 176. Ditch edge protectors 153 and 155 are also provided. The edge protectors 153 and 155 serve the purpose of supporting the weight of the cuttings as they are transported to the side of the ditch. If the weight of the cuttings is allowed to bear on the sharp edge of the cut ditch, the edge will crumble and result in large amounts of "crumbs" falling to the bottom of the ditch which in turn will result in the pipe not reaching the ditch bottom. This was learned in practice on trial runs. Pipe guides 186 extend upwardly and outwardly from support frame 188 which supports it above the plow structure as shown in FIG. 2. Vertical rollers 190 and 192 are on the inside of support structure 188 and the pipe being laid passes through the hiatus 194 which is between the vertical rollers 190 and 192 and above the lower horizontal load and position sensing roller 196 and below the upper horizontal load and position sensing roller 198.

Attention is now directed to FIG. 3 which shows a splitter plate 200 with two spoil diverter boards 202. As shown in FIG. 1, vertical shearing elements 204 extend along the front of vertical member 178.

The plow share just described serves the primary purpose of cutting and elevating the trenched soil up the elevating ramp, thus delivering the cut soil to splitter plate 200 and thence to the diverter boards 202 for transporting the soil away from the ditch sides. The vertical plates 180 of the plow share means also serves to mold the ditch sides. The plow share configuration is akin to a scoop in shape. The horizontal cutting element 176, which is located at the forward lower horizontal edge of the scoop, is robust in strength to suit the requirements or horizontal soil shearing. Members 178 each have forward vertical shearing element 204. Members 178 are each fixed at one end of the horizontal cutting element and thence to the center module structure as depicted in the drawings. The vertical members 178 also serve as strength members to support the horizontal cutting element. It can be appreciated but the loads imparted on the horizontal cutting elements are such that the horizontal cutting element would tend to fail rearward due to the towing force otherwise. The vertical shearing elements, because of their relative robustness, share the dual function of high strength cutting surfaces and support for the horizontal cutting element. The secondary horizontal cutting element 184 can serve as a strengthening member to prevent the failure of the vertical cutting elements in lateral bending due to soil pressures. This secondary horizontal cutting element also serves to shear a portion of the soil. If desired, a tertiary horizontal cutting element could also be incorporated in a similar fashion. The portion of structure aft of the cutting elements 176 is not required to be of the same or as great strength as the cutting elements and can, in fact, be of such less strength because the aft portion is not subject to the high shearing forces. This difference in strength requirement by design is an important feature as it substantially reduces the overall weight of the apparatus and thus the size requirement of the supporting derrick and barge.

The drawings also depict the curve ramp portion 182 of the plow share means which serves to elevate the cut soil from the ditch to above the natural bottom and deliver such soil to a splitter plate and thence to the diverter boards 202. The elevating ramp is supported by side plates 180 which, in effect, encloses the scoop. The side plates are constructed so as to align closely with the vertical shearing elements along the longitudinal axis of the apparatus. The side plate serves two functions which are critical to working soil in a fluid environment. These functions are what enable the apparatus to produce a vertical wall trench. The side plates prevent the cut soil from making contact with the undisturbed soil of the trench walls. Experience has shown this feature to be important as most marine soils of moderate shear strength and cohesiveness are adhesive by nature and will adhere to trench walls and in doing so will disturb the trench walls and cause a cave in of such trench walls. The second function of the side plates is to mold the trench walls in a fashion similar to troweling. Moderately cohesive marine soils will remain intact in a near vertical trench wall for a period of time if they are molded. This period of time is sufficient for the pipeline to reach the trench bottom at normal pipe laying speeds. The side plates allow the trenching plow to work effectively in a great variety of marine soils.

Figure 4:
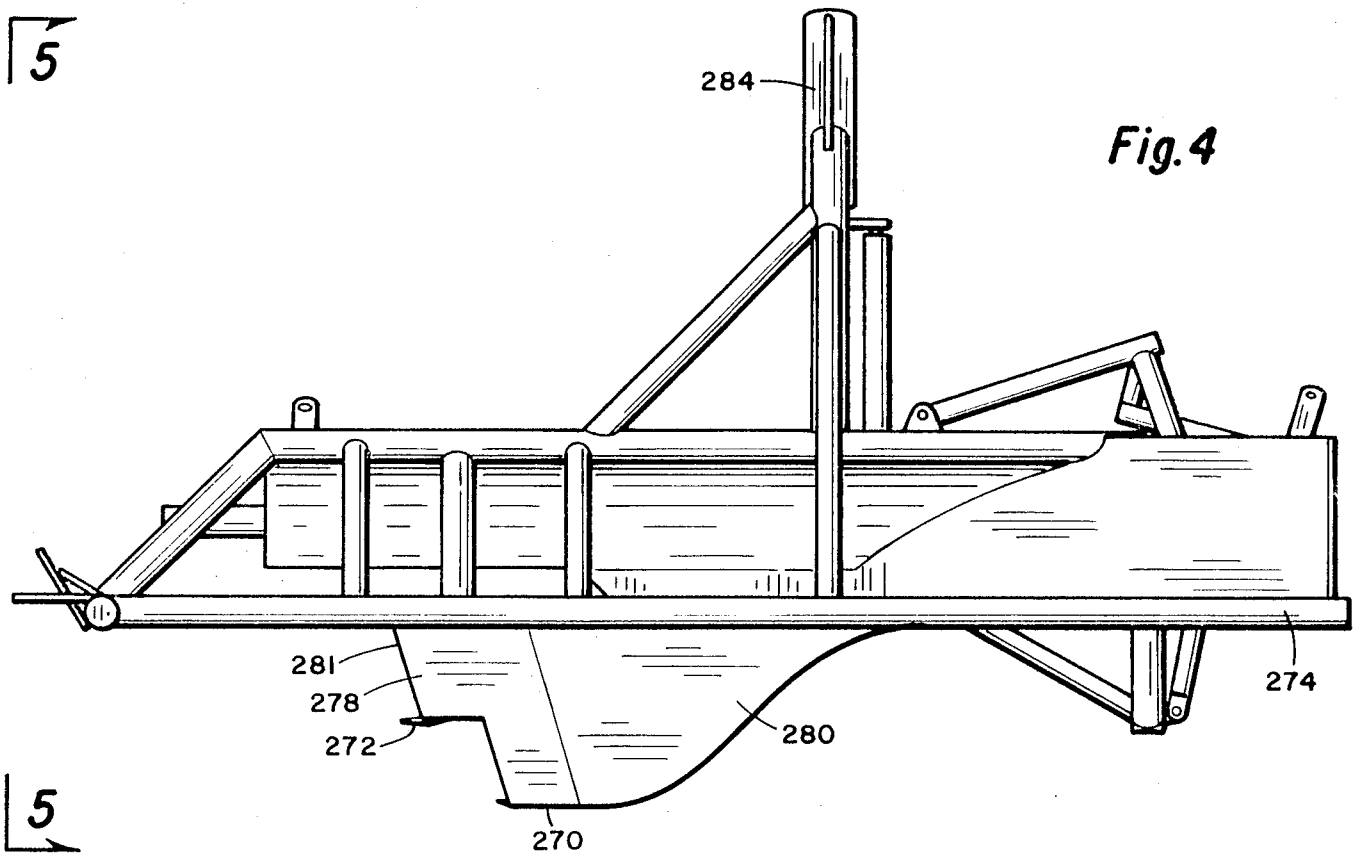
FIG. 4 is a side view of another embodiment of a plow arrangement which is slightly different from that shown in FIG. 1.
Figure 5:
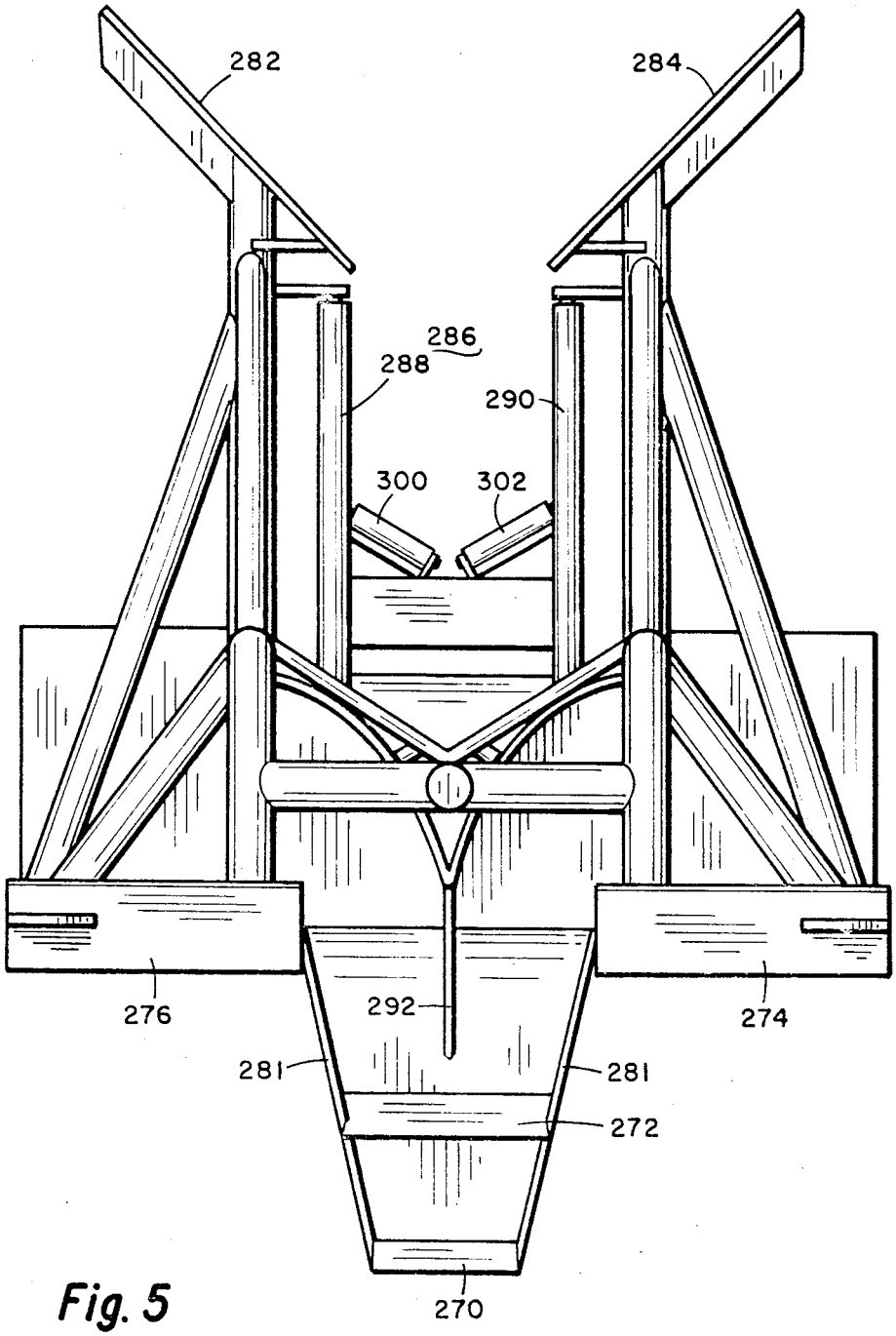
FIG. 5 is another view taken along the line 5—5 in FIG. 4.

Attention is next directed to FIGS. 4 and 5 which shows a slightly different version of my plow from that shown in FIGS. 1, 2 and 3. The position of the cutting elements are significantly different from that of FIG. 1. Shown in FIGS. 4 and 5 is a lower horizontal cutting element 270 which corresponds to cutting element 176 of FIG. 1. In advance of horizontal cutting element 270 is an upper, forward horizontal cutting element 272. As shown in FIG. 5, the upper horizontal forward cutting element 272 is wider than cutting element 270 and thus makes a wider cut which will be in the upper mud/clay which is softer and more likely to cave in at the edges. The lower horizontal cutting element 270 makes a narrow cut in the deeper mud/clay which is always of higher shear strength. This combination cut approach reduces the overall tow force and increases the efficiency of the operation. These horizontal cutting elements 270 and 272 are supported from runners 274 and 276 by vertical support plates 278 with forward cutting edges 281. There is also provided a side plate 280 on either side of the plow and a ramp such as side plates 180 and elevating ramp 182 of the embodiment of FIG. 1. The arrangement of the forward, upper horizontal cutting element 272 and the lower aft horizontal cutting element 270 with supporting members 278 could be readily provided on the embodiment of FIG. 1. The upper structure of the device of FIGS. 4 and 5 is slightly different from that of the device of FIGS. 1 and 2, however, their function is quite similar. The embodiment in FIGS. 4 and 5 includes pipe guides 282 and 284. There is a pipe hiatus 286 which corresponds to hiatus 194 of FIG. 25. Hiatus 286 has two vertical rollers 288 and 290. A splitter 292 similar to splitter 200 of FIG. 3 is also provided. Hiatus 286 also has horizontal or inclinded pipe support rollers 300 and 302.

I have disclosed a simultaneous trenching and pipe laying method in which there is a plow mounted on a sled which is towed by a "tow line" extending from a barge. Also extending from the barge is the pipeline which extends through the pipe laying apparatus which is being towed. This pipe will have what is called a "natural catenary". That is, a specific curve from the barge to the point that the pipe contacts the bottom of the trench which is usually about 400 to 1,000 feet or so behind the pipe laying barge. If this pipe is forced out of its precise catenary, then it will probably be severly damaged and expensive repair operation would have to be conducted. As the plow enters different type soils, the tension on the tow line will be changed. When the plow is going through relatively soft bottoms, there will be less tension on the tow line and it will curve down or sag down. However, when hard clay is encountered, which can be encountered in the matter of a few feet movement of the plow, there will be much more force required on the tow line to pull the plow through the soil that can make that trench. Thus, the tow line may become nearly straight. This permits the distance between the boat and the trenching apparatus to increase. If this distance increases too much, the pipe will likely contact the trenching apparatus at the wrong point along its catenary curve. This may force the pipe out of its natural curve which likely will damage the pipe. I have disclosed a procedure and apparatus to prevent this problem. In one embodiment I have a sensing roller in the pipe laying apparatus placed beneath the normal position of the pipe. When the pipe contacts the roller, the operator can determine the downward force applied to it and know if adjustments must be made. He will use this downward force to adjust the lenth of the towing line so that the pipe laid will not fall on this horizontal sensing roller. The main reason why it is preferable that the pipe be positioned in the roller hiatus between the lower horizontal roller and below the upper horizontal roller without substantial contact of either is that the objective is to have the pipe completely supported by the earth at the trench bottom. This is some point behind the pipe laying machine. The soil distributes the pipe bearing load over a substantial distance along the pipe in a soft yielding medium as opposed to point contact on a roller on the pipe laying device which is a very high bearing load contact. The roller, even though covered with a rubber coating, is a relatively hard surface in comparison to the soil. This phenomenon takes on special significance when the pipe is undulating due to sea states induced motion.

Another reason for having the full pipe weight right on the trench bottom is to crush the crumbs of soil that sometimes fall into the trench or squash them to one side of the trench pipe. If some of the pipe weight is supported by the roller there is a good chance that the chunks won't be crushed or be squashed to the side. This is important in that these crumbs are usually quite firm and can actually prevent the pipe from reaching the trench bottom. This could be a financially disasterous situation because the pipe would not be at full contract specified depth and the only way to get it down would be to bring out a jet barge which would triple the cost of the operation.

Figure 6:
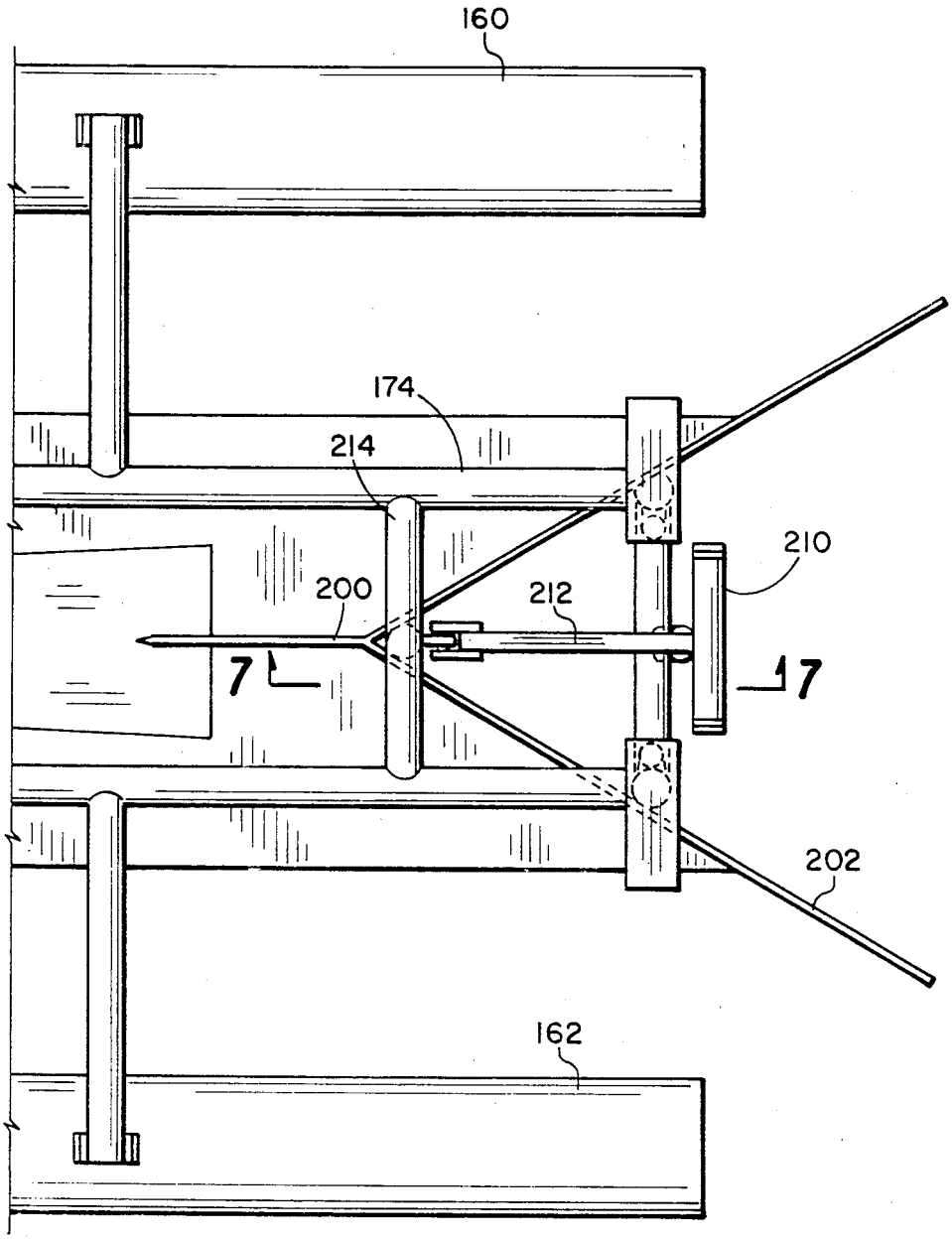
FIG. 6 illustrates a top view which illustrates a bottom roller supported by a hydraulic linear actuator which is useful for sensing the pipe elevation within the guide rollers and with cushioning effect.
Figure 8:
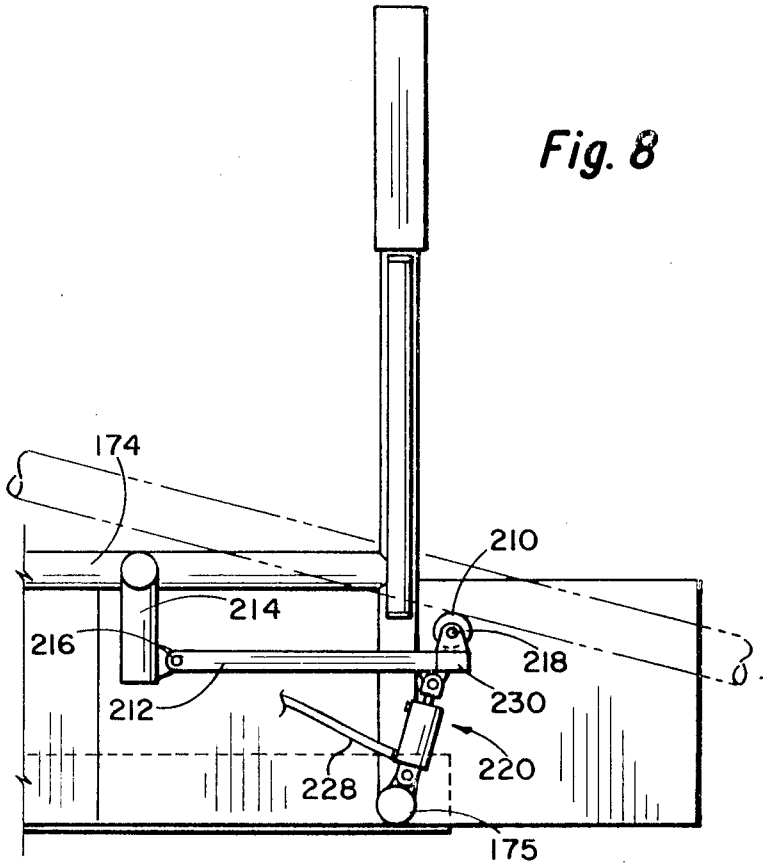
FIG. 8 is similar to FIG. 7 except the pipeline has added weight to the lower roller and it has compressed the fluid within the support fluid actuator.
Figure 7:
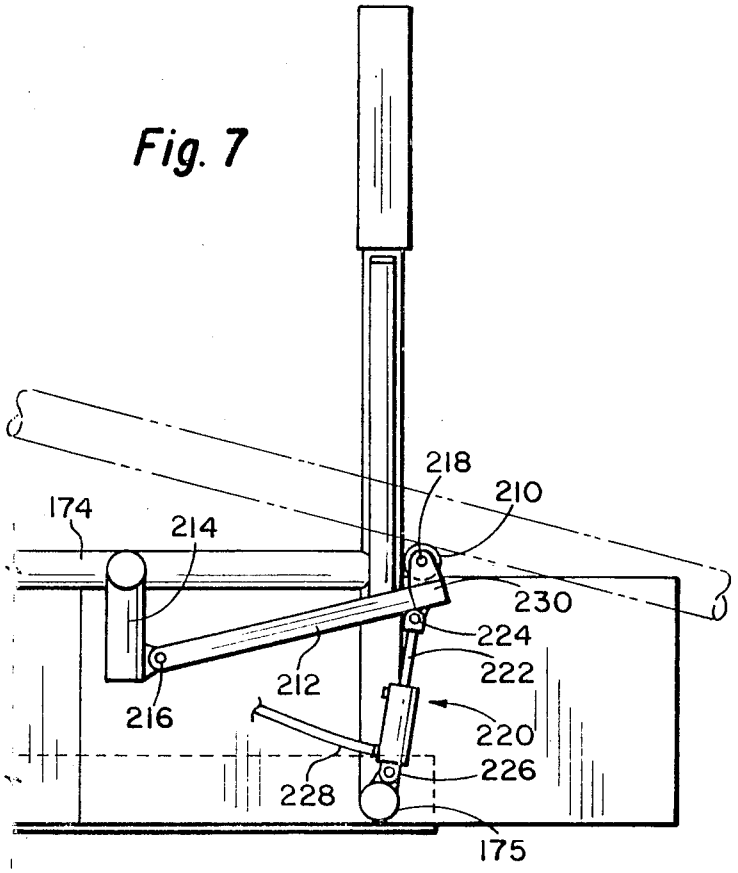
FIG. 7 is a view taken along the line 7—7 of FIG. 6 and shows the lower roller cushion for detecting the load on and the position of the pipe.

Attention is now directed to FIGS. 6, 7 and 8 which shows an embodiment of the invention concerning the lower horizontal roller of the pipe guide roller arrangement. A lower horizontal roller 210 is mounted on a frame 212 which is pivotally connected to element 214 of the center module frame 174 of the plow. A vertical support member 214 is rigidly attached at its upper end to the center module frame 174. A pivot 216 connects frame 212 in a pivotal manner to this vertical member 214. Horizontal load and position sensing roller 210 is pivotally supported from frame 212 by pivot 218. Frame 202 is connected to Tee member 230 which extends under roller 210 and supports pivot 218 on each end thereof. Thus, it is seen that with the roller 210 mounted on the extremity of the frame 212 from pivot 216 that the roller can traverse through a vertical arc. The frame 212, at its extremity from the end of pivot 216 is interconnected with the lower portion 175 of the center module frame 174 by a hydraulic linear actuator 220. Preferably, an accumulator type hydraulic circuit is incorporated with the hydraulic linear actuator, which is also commonly referred to as a gas over oil circuit, so as to cause the linear actuator to function as a gas spring. The ratio of gas to oil volumes and initial charge pressures are adjustable so as to be able to vary the spring rate. It is the nature of a gas spring for the pressure to increase in a mathematical curve as the cylinder is compressed.

Piston rod 222 of hydraulic linear actuator 220 is pivotally connected at 224 to frame 212. The housing of the linear actuator 220 is connected at pivot 226 to member 175 of the center module frame 174.

Figure 9:
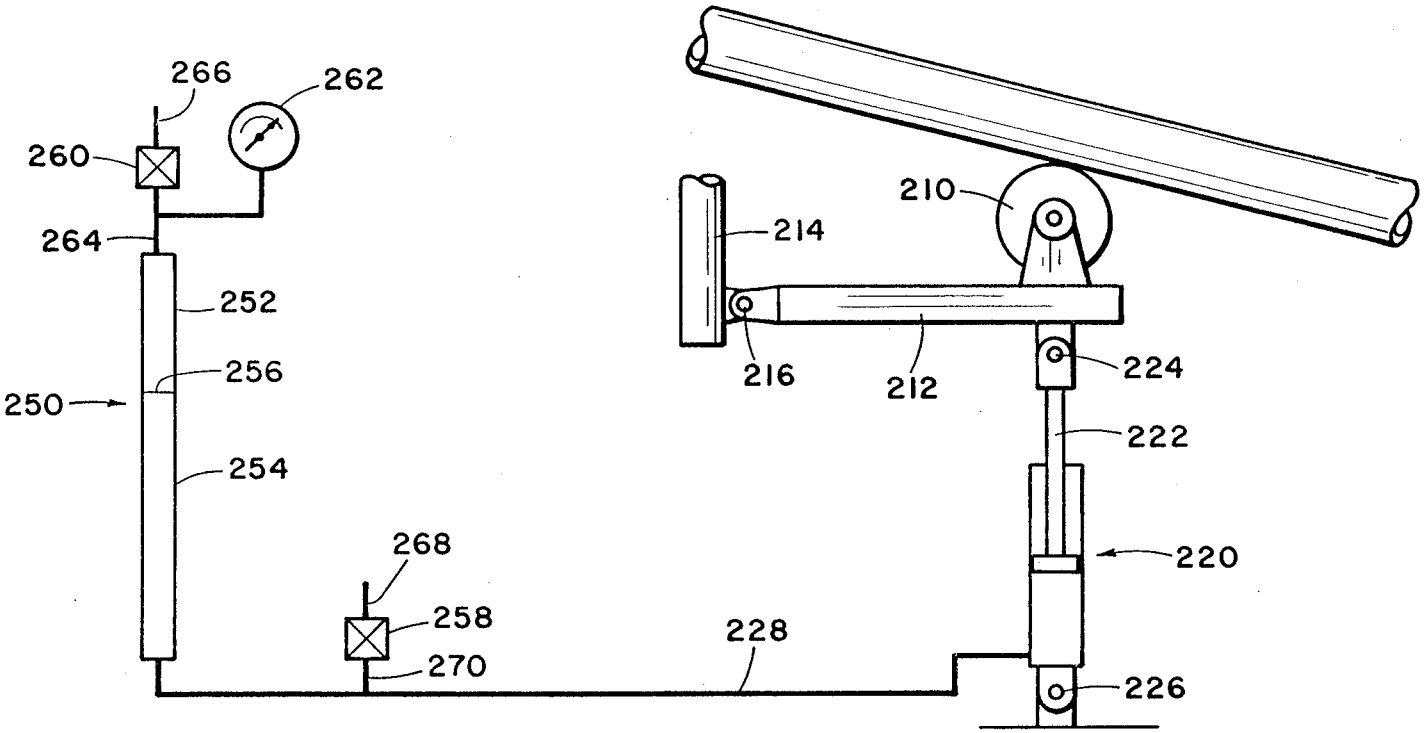
FIG. 9 shows a hydraulic flow diagram for the bottom roller supported by hydraulic linear actuator of FIG. 6.

The gas spring can be calibrated so that the range of pressures generated by the spring travel could be interpreted to determine the horizontal roller travel in the vertical plane. Thus a specific pressure in an accumulator circuit could be converted to a specific vertical position of the horizontal roller 210. A hose 228 can be connected and be a part of the accumulator circuit and can extend to the barge so that the pressure of fluid in the hose 228 can be observed by the operator of the laying barge. FIG. 9 shows a hydraulic circuit for the gas spring arrangement of FIGS. 7 and 8. Hose or conduit 228 is connected to the lower end of a cylinder 250 which has gas 252 in the upper end and an oil at 254 in the lower end with an interface 256 therebetween. Hose 226 connects to the lower end of cylinder 250. Oil may be added or removed by use of valves 258 having outlet 268 and a conduit 270 in fluid communication with the hose 228. The upper end of the cylinder 250 is in fluid communication through conduit 264 to valve 260 and also to pressure gauge 262. Gas can be added through inlet 266 of valve 260 and conduit 264 to the upper end of cylinder 250. Thus this improved arrangement shown in FIGS. 6, 7, 8 and 9 allows the operator to know the position of the pipeline within the hiatus 194 (See FIG. 2) of the guide rollers which is preferable over just knowing when the pipe contacts the fixed horizontal roller.

It can also be understood that the accumulator circuit working pressure can be adjusted so that the pressure generated from the horizontal roller 210 in the lowermost position of its travel range is sufficiently high so as to alert the operator that the force on the roller 210 was dangerously high and that the plow must be repositioned in relation to the barge.

The gas spring support of the lower horizontal roller as shown in FIGS. 6, 7, 8 and 9 can be adjusted to provide a cushioning effect to the pipe. Thus when the pipe is undulating due to the sea state induced motions of the laying barge, which is very often the case, the impact of the pipe on the roller can be minimized thus greatly reducing the chance of damage to the pipe or its coating.

To briefly recapitulate the advantages of the embodiment of FIGS. 6, 7, 8 and 9, it can be said that mounting the lower horizontal roller 210 on an adjustable gas spring provides two benefits to the operator. In addition to providing a vertical force indication, the operator has an indication of the actual position of the pipe in the roller guide system and thus can keep the pipe in the preferred position of the mid range of the vertical rollers. A second benefit lies in the snubbing action which offers previously unavailable protection to the pipe and its coating.

In certain conditions such as shallow water operations, the lower horizontal roller 210 may be fixed in position. Roller 210 can be fixed in position by any known means. For example, bracket 212 could be fixed to the vertical member 214 by omitting pivot 216 and connecting them together by any well known means such as by welding. In this case the sensing function of the load cell or the gas spring is replaced by a television camera with remote mounting so an operator may visually monitor the pipe position. In this arrangement the pipe position is observed in relation to the horizontal roller and the barge operator adjusts the plow position accordingly. Thus, the desired configuration of the pipe being positioned nominally in the mid-point of the hiatus of the guide rollers can be accomplished by direct diver observation and verbal instructions. This may also be a preferable mode of operation when heavy seas are running which would cause the pipe to continually impact the horizontal roller due to the lay barge heaving. A diver observation may in some instances better position the pipe in the hiatus so that its vertical oscillation range is not allowing the pipe to make high force impacts on the horizontal roller.

Referrring to FIGS. 10, 11, 12, 13, 14, 15 and 16, reference character 10 generally indicates a different embodiment of a combined trenching and pipe laying apparatus comprising a suitable skid means or assembly 12 having a pair of spaced substantially mutually parallel runners 14 and 16 adapted for disposition on the bottom of a body of water during a trenching and pipe laying operation. The runners 14 and 16 are preferably provided with beveled leading or forward ends as shown at 18 in FIG. 10, to facilitate the movement of the skid assembly 12 over the bottom of the body of water, and suitable means 20 is provided on the forward or leading ends of each runner 14 and 16 for connection with a towing barge or vessel (not shown) by a usual tow rope 22, all as is well known in the art.

Figure 10:
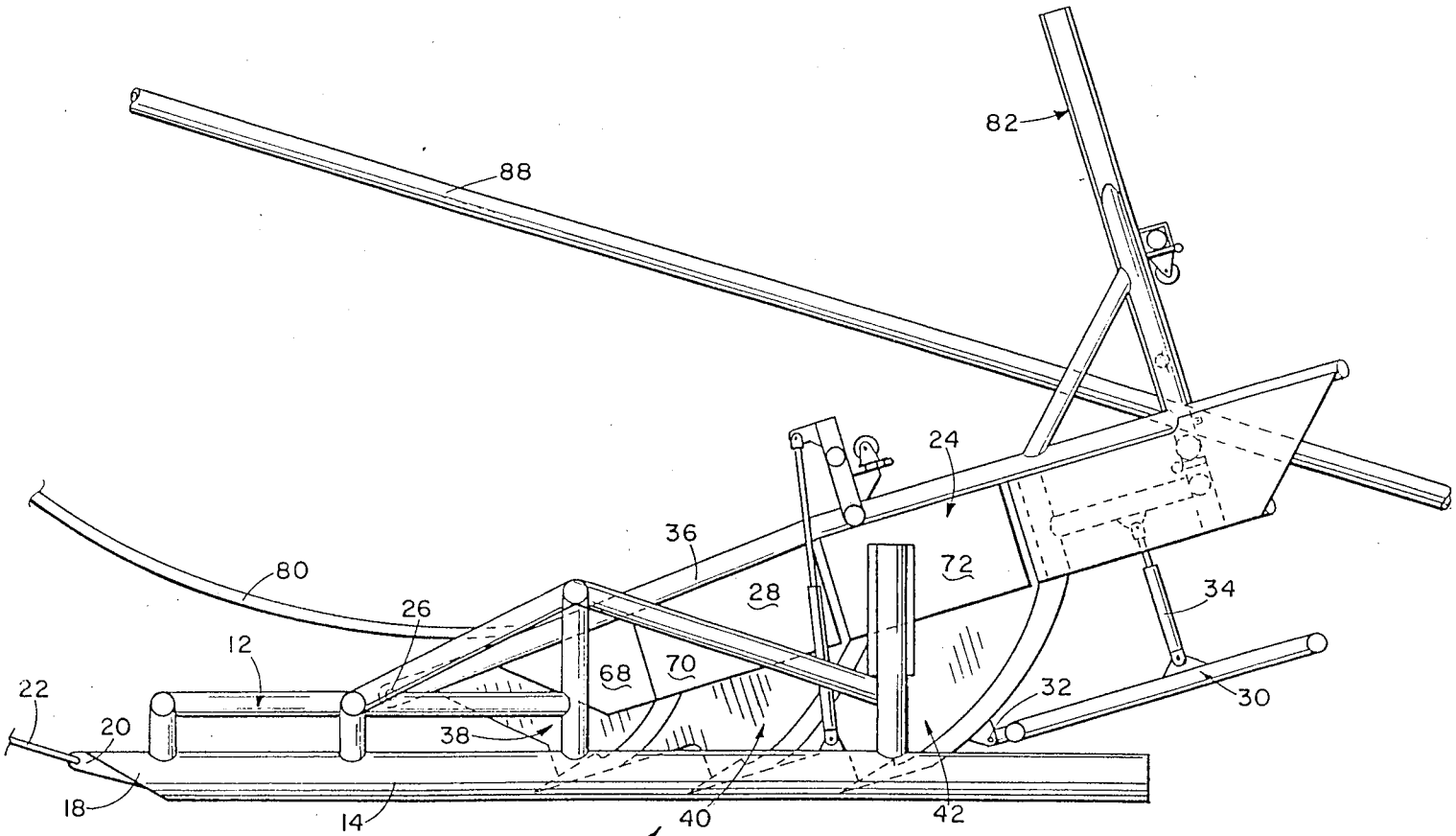
FIG. 10 is a side elevational view of a combined trenching and pipe laying apparatus embodying an embodiment of the invention, and illustrates the trenching apparatus in a raised position.
Figure 11:
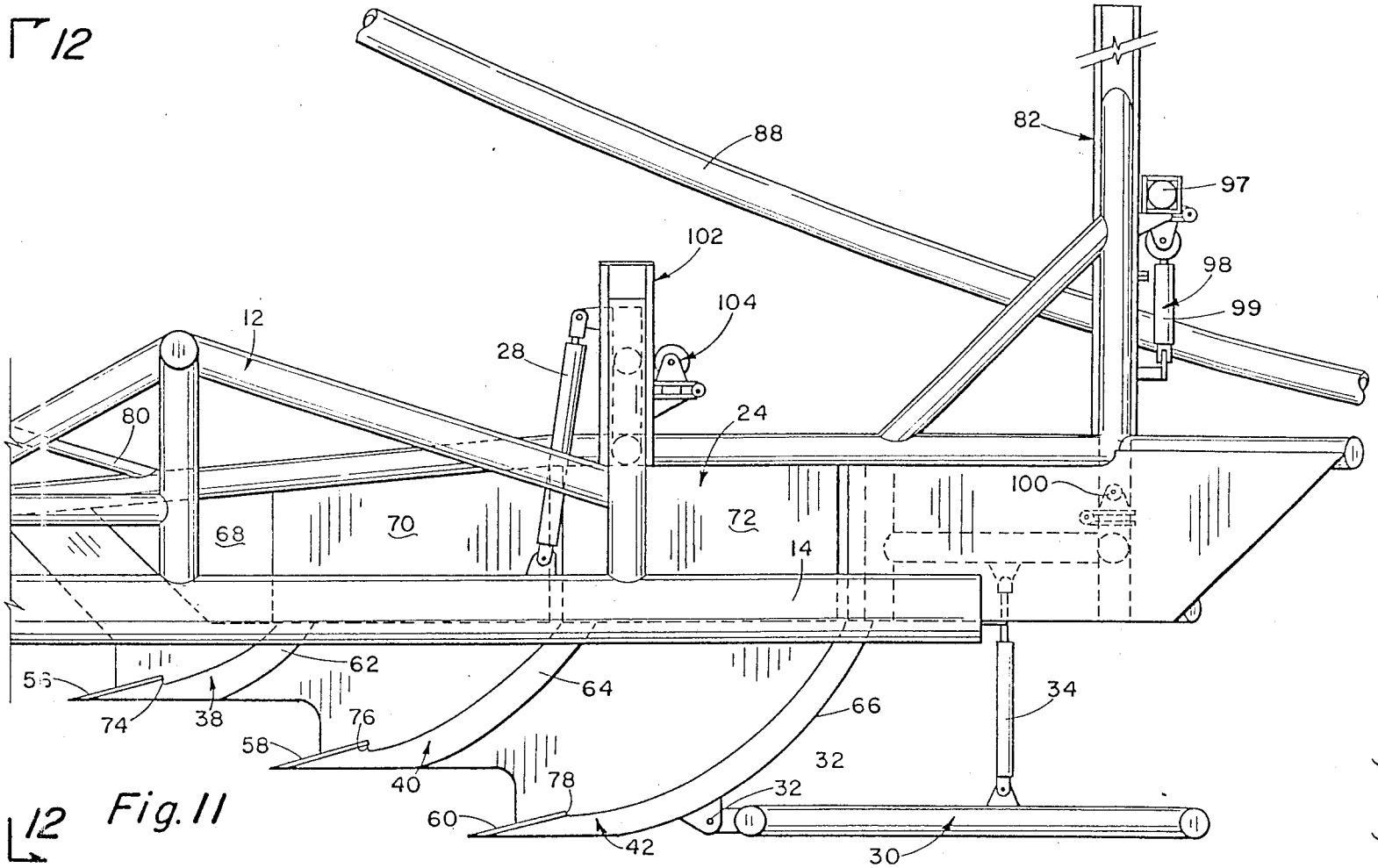
FIG. 11 is a broken side elevational view of a combined trenching and pipe laying apparatus embodying the invention, and illustrates the trenching apparatus in a lowered position.

A plow assembly 24 has one end pivotally secured to the skid assembly 12 in any suitable manner, and as shown at 26 whereby the assembly 24 may be selectively moved between a raised position as shown in FIG. 10 and a lowered position as shown in FIG. 11. In the raised position of the plow assembly 24, the apparatus 10 may be towed along or over the bottom of the body of water without disturbing any previously laid pipe, or the like, which may be present in the area wherein the pipe laying and trenching operation is occurring. In the lowered position of the plow assembly 24, a trenching operation may be achieved, as will be hereinafter set forth. In order to raise and lower the plow assembly 24 or pivot the assembly 24 about the pivot connection means 26, it is preferable to operably secure suitable cylinder and rod means 28 between the skid assembly 12 and the plow assembly 24. It will be apparent that extension of the rod and cylinder means 28 as shown in FIG. 10 will elevate the assembly 24 with respect to the bottom of the skid assembly 12 and contracting of the rod and cylinder means 28 will lower the plow assembly into the plowing position thereof. This is an important feature since there are many marine or underwater locations in offshore oil fields whereby many pre-existing pipelines have been buried to a depth of approximately three feet. The pivotal feature of the novel apparatus which permits the raising of the cutting elements allows the apparatus to be moved over or across an existing pipeline installation without damage thereto and without impediment of the operation of the novel combined trenching and pipe laying apparatus.

It may be desirable to provide a depth regulating pad means 30 at the trailing end of the plow assembly 24, although many installations will not require such an element. The depth regulating pad means may have one end pivotally secured to the rear portion of the plow assembly in any suitable manner, such as shown at 32, and suitable cylinder and rod means 34 may be operably connected between plow assembly 24 and the depth regulating pad means 30 for pivoting of the pad means about the pivot connection 32. The soil encountered at the bottom of the trench is normally of a higher bearing resistance than the soil at the mud line, thus the use of the depth regulating means at the bottom of the trench permits a more precise control of the trench depth. A plurality of suitably cushioned roller means is provided, preferably at the rearward portion of the apparatus, for guiding the pipe being fed from the lay barge into the trench which has been dredged by the cutting elements disposed forwardly of the rollers.

In this particular embodiment, the plow assembly means comprises a suitable support structure 36 having a plurality of plows 38, 40 and 42 mounted on the lower or under side thereof in spaced in-line relationship. In one embodiment discussed later herein, one plow may be used.

The process of plowing an underwater trench is by nature one which involves massive forces and thus imposes extremely high loadings on a plow structure. Inasmuch as the overall weight of the plow apparatus is often limited by the crane capacity of the supporting vessel, it is most desirable that a plow be designed for maximum strength/weight efficiency. Naturally, the maximum loads imposed on a plow structure occur at the cutting elements. By distributing the cutting action on more than one cutting element, the members that support each cutting element can be lighter and more slender in profile. The lightness or thinness of the cutting elements and their support structure are significantly important in that the greater the thickness of the cutting element the greater the force required to force it through the medium being cut.

Figure 12:
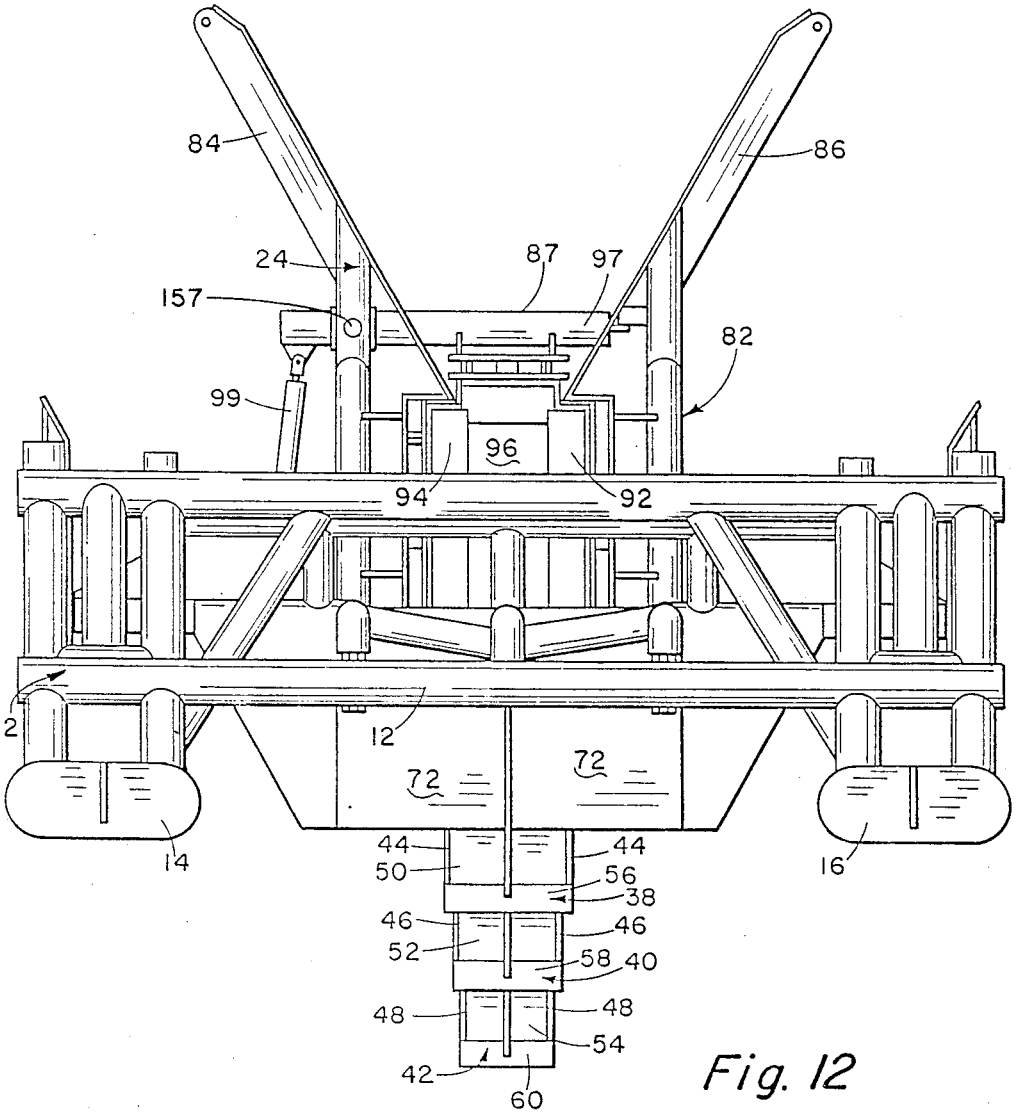
FIG. 12 is a view taken on line 12—12 of FIG. 11.

The plows 38, 40 and 42 preferably each comprise a pair of substantially mutually parallel spaced side plates 44, 46 and 48, respectively (FIG. 12). Each pair of plates 44, 46 and 48 is rigidly secured to an arcuate bottom plate 50, 52, and 54, respectively, whereby each plow 38, 40 and 42 is of a substantially scoop-shaped configuration, with the forward or leading ends thereof open to perform the plowing operation. The arcuate bottom plates 50, 52 and 54 function as elevating ramps for the respective plow. Of course, each plow 38, 40 and 42 is also provided with a sharp cutting edge means or elements 56, 58 and 60, respectively, (FIG. 11) as is well known, for facilitating the penetration of the soil by the plows during a plowing or trenching operation, as will be hereinafter set forth. Centrally disposed longitudinally extending rib members 62, 64 and 66 are rigidly secured to the outer surface of the arcuate plate members 50, 52 and 54, respectively.

Each arcuate plate means or elevating ramp 50, 52 and 54 terminates at the upper end thereof in communication with a V-shaped diverter plate means 68, 70 and 72, respectively. In addition, step means 74, 76 and 78 is provided at the juncture of each cutting element 56, 58 and 60 with its respective elevating ramp 50, 52 and 54. The step members 74, 76 and 78 permit or provide for the injection of lubricating water between the cuttings and the elevating ramps during a trenching operation, thus minimizing the friction and aiding in the elevation of the cuttings away from the bottom and sides of the trench. The step members further fracture the cuttings which enhances the co-mingling of the cuttings and the lubrication water during the trenching operation, thus increasing the overall efficiency thereof. It may be desirable to provide lubrication water jet nozzle means (not shown) at the apex of each diverter plate means 68, 79 and 72, and a jet water hose 80 may be secured to the plow assembly 24 in open communication with the jet nozzles for supplying the lubrication water thereto, as is well known. It may also be desirable to provide water jet means (not shown) at each step 74, 76 and 78 for directing lubrication water to the associated elevating ramp during a trenching operation.

The trailing end of the plow assembly 24 is provided with an upstanding frame assembly generally indicated at 82 having a pair of spaced outwardly diverging support arm members 84 and 86 forming a substantially V-shaped trough 87 therebetween for receiving a length of pipe 88 to be layed or deposited in the trench being excavated by the plows 38, 40 and 42. The V-shaped trough 87 is open to a hiatus 96 provided between a pair of spaced upright roller means 92 and 94 and directs the pipe 88 into a position within the hiatus during the pipe laying operation as will be hereinafter set forth. The roller means 92 and 94 are suitably mounted on the upright support means 82. At least one horizontally extending sensing roller means 100 is provided on the upright support apparatus 82 and disposed at the proximity of the bottom of the hiatus 96 for sensing the pipe there against during a pipe laying operation.

A second upright support assembly 102 is secured on the plow assembly 24, and is provided with at least one horizontally extending sensing roller means 104 adapted to receive the pipe 88 thereagainst prior to the entry of the pipe into the hiatus 96. The load cells and/or sensing rollers are operably connected with suitable or well known gauging equipment or apparatus (not shown) provided on the towing vessel or barge (not shown), and are operable by the engagement of the pipe 88 therewith for transmitting information to the personnel on the barge relating to the position of the pipe during the laying operation, we will be hereinafter set forth.

Figure 13:
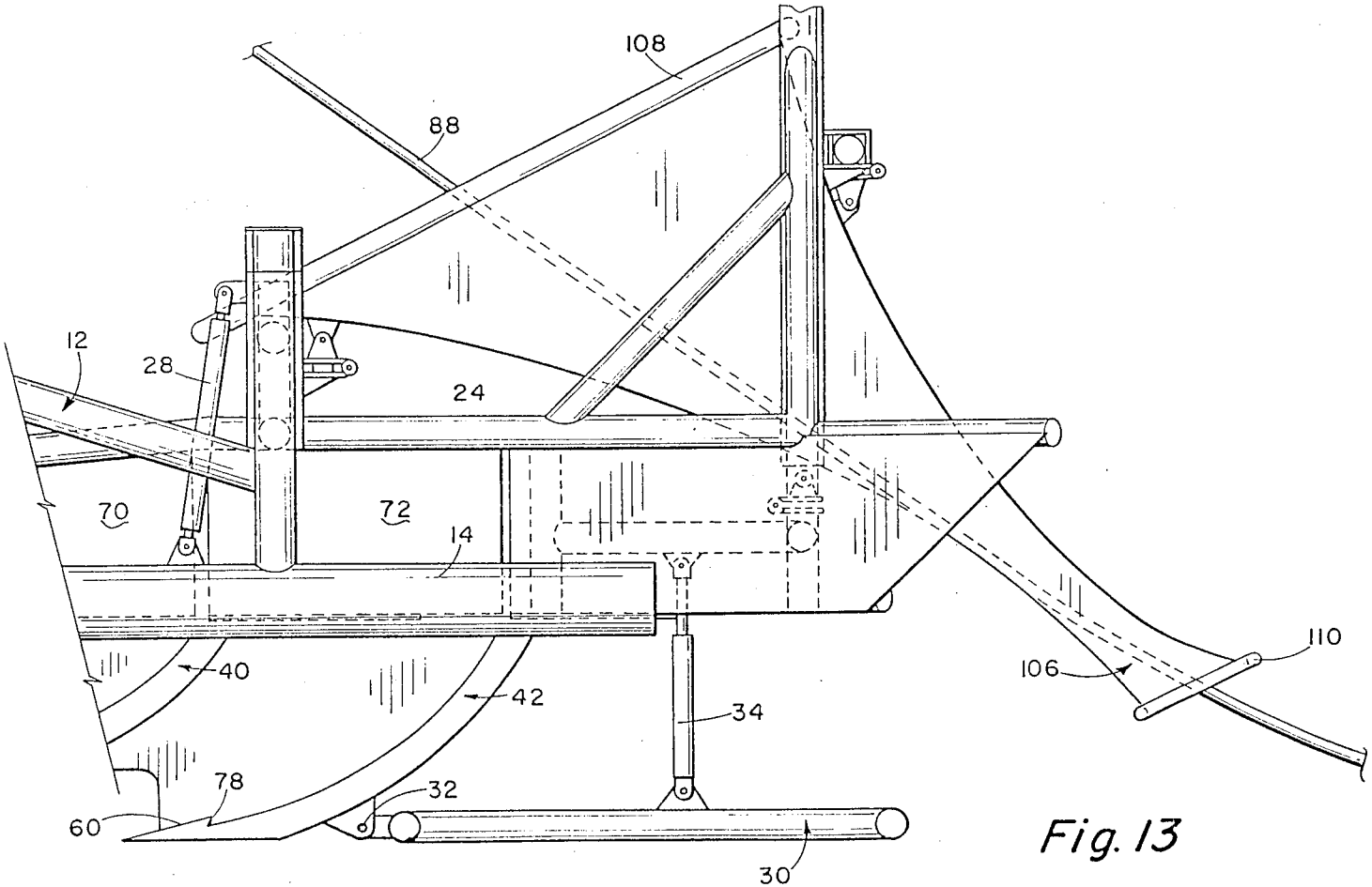
FIG. 13 is a broken side elevational view of a combined trenching and pipe laying apparatus embodying the invention and particularly illustrates
Figure 14:
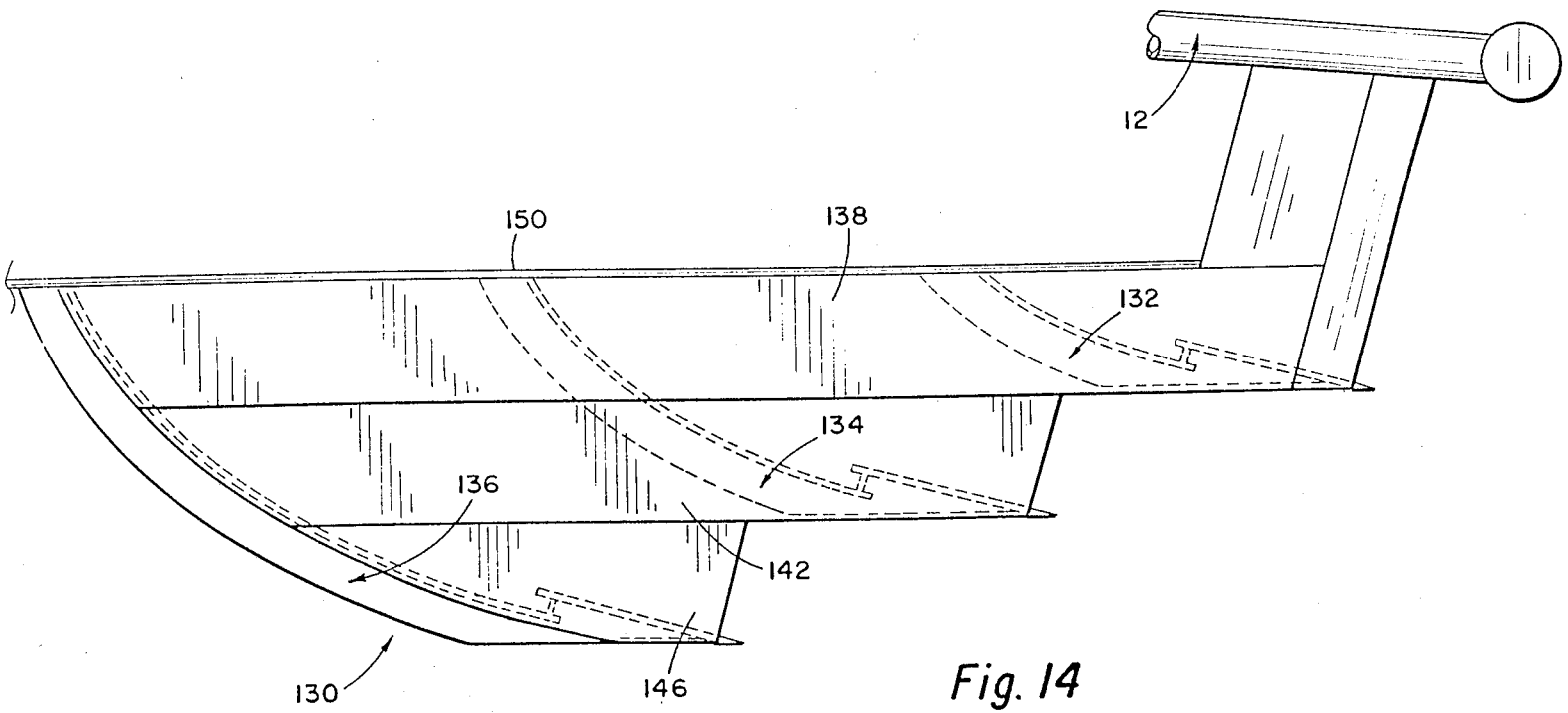
FIG. 14 is a side elevational view of a modified plow structure.
Figure 15:
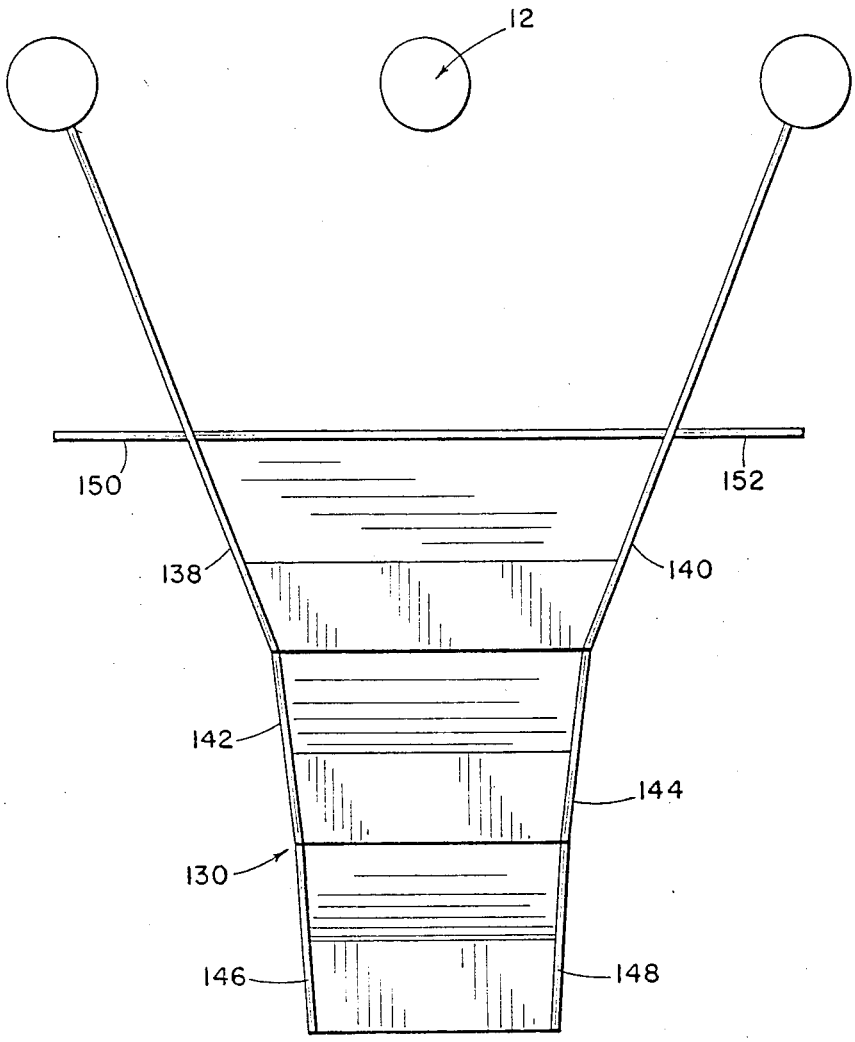
FIG. 15 is an end elevational view of the plow structure shown in FIG. 14.
Figure 16:
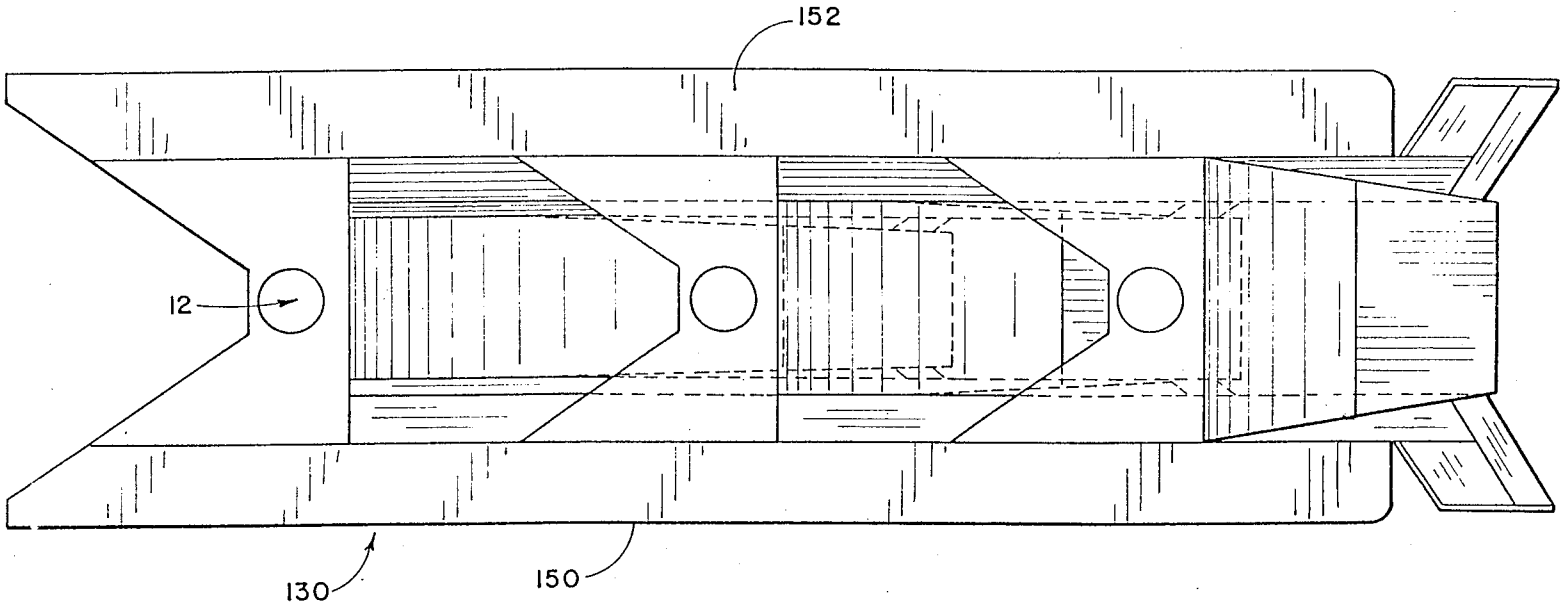
FIG. 16 is a plan view of the plow structure shown in FIG. 14.

Referring now to FIG. 13, an instrumented cable guide chute means is generally indicated at 106 and may be secured to the plow assembly 24 in any suitable manner to provide a chute for receiving the cable 89 therethrough or thereagainst during a pipe laying operation. The chute means 106 is preferably provided with suitable sensing rollers 108 and 110 at the opposite ends thereof which are "instrumented" in any well known manner for "telling" or transmitting load information to the surface of the body of water or to the gauging instrumentation provided on the lay barge. The load of the cable 89 on the chute means 106 may be transmitted for visual interpretation by the personnel on board the lay vessel in order to ascertain the progress of the cable laying operation.

In use, the apparatus 10 initially opens a trench on the floor or bottom of a body of water and lays the pipe in the opened trench simultaneously with the continued dredging of the trench ahead of the pipe being laid therein. The skid means 12 may be pulled over the bottom or floor of the body of water by the tow rope 22 secured between the lay barge or vessel and the skid means 12, as is well known. The cylinder and rod means 28 may be actuated in any suitable or well known manner for contracting of the rod whereby the plow assembly 24 is disposed in the lowermost position thereof, thus engaging the floor or bottom of the body of water. The elevating ramps 50, 52 and 54 direct the cuttings upwardly from the bottom and sides of the trench and into contact with the respective diverters 68, 70 and 72. The diverters direct the cuttings in a direction to the sides of or away from the open trench. In addition, the steps 74, 76 and 78 fracture the cuttings, thus facilitating the dispersing thereof by the diverter plates. Blade lubricating water is directed into the cutting substantially immediately or directly behind the cutting elements 56, 58 and 60, which reduces the friction between the cuttings and the elevating ramps.

The pipe 88 is carried by the plow assembly 24 and is directed above the sensing roller means 104 and through the hiatus 96 for engagement with the open trench substantially immediately behind the apparatus 10. As the apparatus 10 is moved over the floor of the body of water in a forward direction, the trench is opened by the plows 38, 40 and 42, and the pipe 88 is deposited within the open trench in the area thereof behind the forwardly moving apparatus 10.

It may be desirable to utilize the depth regulating pad means 30 during the trenching operation. If so, the pad means may be forced downwardly against the bottom of the trench, thus limiting or determining the position of the trailing plow 42 and controlling the ultimate depth of the trench. In many instances, however, it is found that this feature is not required.

In the event the apparatus 10 approaches an area of the floor of the body of water wherein previously laid pipe, cable, or the like is present, and it is not desirable to disturb same, the rod and cylinder means 38 may be actuated in the well known manner for pivoting the plow assembly 24 about the pivot 26 for elevating the plows 38, 40 and 42 to a position above the bottom or floor of the body of water. The apparatus 10 may then be towed or moved through the water without engagement of the bottom by the plows, thus avoiding any damage to pre-existing buried (or unburied) equipment.

The sensing roller means utilized in the apparatus of the invention are preferably covered or coated with rubber, or the like, for precluding damage to the outer periphery of the pipe 88 in the event the pipe comes into engagement therewith. The V-shaped configuration of the trough 87 facilitates the positioning of the pipe 88 within the hiatus 96, and since this is frequently accomplished when the pipe is under water and not readily visible, this feature becomes of value.

The signalling feature of the apparatus 10 wherein the under water orientation of the pipe may be detected from the surface of the water is important in the overall operation of the apparatus 10 since the catenary curve of the pipeline is critical to prevent damage to the pipe during the laying operation. The sensing of the load on the sensing cells readily determines whether or not the catenary curve of the pipeline is within the permissible limits, thus providing not only an efficient trenching operation, but also an efficiently controlled pipe laying operation.

As will be seen in FIG. 12, the sensing means includes an upper sensing roller 97 which normally horizontally disposed across the upper end of the hiatus 96. The roller 97 is preferably pivotal about one end thereof whereby the roller may be moved toward a substantially vertical orientation for providing access to the hiatus 96 when the pipe 88 is initially installed or admitted into the hiatus. The roller 97 may be pivoted about the one end thereof at pivot 151 in any suitable manner, such as by a fluid cylinder means 99, and may be returned to the normal horizontal position therefor when the pipe 88 has been inserted into the hiatus 96. The sensing rollers 97 and 100 provide a signal at the surface or remote from the pipe laying apparatus when the orientation of the pipe is excessively high or low within the hiatus 96, thus permitting the operating personnel to adjust the position of the pipe to the optimum underwater position therefor, which is preferably substantially centrally disposed within the hiatus. The pipe 88 extending through the hiatus 96 in the natural catenary angle therefor is laid into the ditch or trench opened by the plow apparatus, and is essentially supported by the bottom of the ditch during the pipe laying operation.

In actual underwater ditching operations, it has been found that different types of marine soils respond to the plowing operation in different or unique ways and as a result it is not practical to consider that a single plow structure may be efficiently utilized in all soil environments. Some marine soils resist an "upright" standing position at the sides of a ditch opened therein, and may fall into the ditch or tend to reclose the ditch. In this case, the particular plow configuration shown in FIGS. 15, 16 and 17 may be utilized in lieu of the plow configuration shown in FIGS. 10 through 14. Reference character 130 generally indicates a modified plow structure comprising plow shares 132, 134 and 136 which are substantially identical to the plow shares 38, 40 and 42, respectively, as hereinbefore set forth and which function in substantially the same manner during a trenching or ditching operation.

The opposite sides of each plow share 132, 134 and 136, however, are enclosed by sidewalls which extend rearwardly from each plow substantially throughout the length of the skid 12 and ride along the sides of the trench or ditch as it is opened by the plows. As shown herein, a pair of spaced elongated plates 138 and 140 extend downwardly from the skid assembly 12 substantially throughout the length thereof and preferably are disposed at a downwardly diverging angle with respect to each other. The plates 138 and 140 form sidewalls for the leading plow share 132 and as the plow 132 initially opens the trench the walls 138 and 140 slide or glide along the opened trench for packing the soil behind the plow 134 for substantially precluding collapsing of the ditch as the trench is opened. A second pair of spaced elongated plates 142 and 144 may be suitably secured along the lower edge of the plates 138 and 140, respectively, and form sidewalls for the plow share means 134 and extend rearwardly therefrom to perform substantially the same function as the plates 138 and 140. It may also be preferable that the plates 142 and 144 be inwardly and downwardly diverging with respect to one another. Another pair of spaced elongated plates 146 and 148 may be suitably secured along the lower edge of the plates 142 and 144, respectively, and form sidewalls for the plow share means 136 and extend rearwardly therefrom for substantially the same purpose as the plates 138 and 140, and the plates 142 and 144. Here again, it may be preferable that the plates 146 and 148 be inwardly and downwardly diverging with respect to one another.

In addition, in order to facilitate the stabilization of the upper surfaces of the sides of the trench during the ditching or trenching operation it may be desirable to provide oppositely disposed flange or shelf means 150 and 152 for the apparatus 130 adapted to glide or ride along the bottom of the body of water and at the sides of the opened trench. The flanges 150 and 152 may be in the form of elongated substantially horizontally disposed plates secured to the opposite sides of the walls 138 and 140 and at the upper edges thereof whereby the plates 150 and 152 will be disposed against the horizontal surfaces at the upper end or edge of the opened trench. It will be apparent that the apparatus 130 provides wall means adapted to slide along the downwardly extending substantially vertical sidewalls of a ditch during the trenching operation as well as shelf or flange means adapted to move or slide over the bottom surface of the water immediately adjacent the side edges of the opened trench, thus facilitating the opening of a trench in relatively unstable soil or the like which resists stabilization of the sides of the opened trench. As explained above in regard to edge plates 153 and 155 of FIGS. 1, 2, and 3, these edge plates 150 and 152 help prevent the side walls from crumbling.

From the foregoing it will be apparent that the present invention provides a novel combined trenching and pipe laying apparatus wherein the trenching operation is achieved by a plurality of progressive depth plow members, and the pipe is laid in the opened trench substantially immediately behind the plows. Sensing means is provided for ascertaining the orientation of the pipeline being laid in the trench whereby a control of the catenary curve of the pipe may be maintained during the pipe laying operation for substantially precluding accidental damage to the pipe during the laying thereof.

Whereas the present invention has been described in particular relation to the drawings attached hereto, it should be understood that other and further modifications, apart from those shown or suggested herein may be made within the spirit and scope of this invention.

What is claimed is:

1. A method of simultaneously digging a trench in the bottom of a body of water and laying a pipe from a barge therein which comprises the steps of:

forming a trench in said bottom by towing a trenching machine by said barge using a tow wire;

feeding and extending said pipe from said barge into said trench such that said pipe forms an unsupported catenary curve, a locus of which extends through, but not touching, a hiatus defined by a top, bottom, and two sides relative to said trenching machine;

sensing the locus of said pipe within said hiatus by transmitting a signal to said barge in the event said pipe contacts said top or bottom of said hiatus; and maintaining said locus substantially constant from said barge by adjusting the length of said tow wire.

2. The method of claim 1 wherein said sensing of said locus occurs by underwater videoing of said hiatus.

3. A combination trenching and pipe laying apparatus for laying pipe in the floor of a body of water using a barge comprising:

a frame supported upon parallel skid means for traversing along said floor;

tow wire means connected between said barge and said frame, and means on said barge to adjust the length of said tow wire;

a plow means connected to and below said frame for forming a substantially vertical sidewall trench in said bottom, said plow means having a leading forward end and a trailing end and formed of a pair of spaced substantially vertical and parallel planar side plates and an arcuate bottom plate curving upwardly and rearwardly to a means to facilitate the removal of cuttings upwardly and outwardly to both sides of said trench, said leading forward end of said vertical planar side plates and said arcuate bottom plate defining a cutting edge means;

an upstanding framework connected to and above said frame forming a hiatus defined by a top, bottom, and two sides;

means on said barge to feed and extend said pipe downwardly into a bottom of said trench formed by said plow such that a preferred locus of said pipe forms an unsupported catenary curve that extends through said hiatus without contact with said top, bottom, and two sides;

means relative to said framework to sense contact of said pipe with said top or bottom within said hiatus; and means to transmit a signal indicative of said position to an operator on said barge whereby said operator can maintain said locus substantially constant by adjusting the length of said tow wire.

4. The combination of claim 3 wherein said means to sense said position comprises a roller forming the bottom of said hiatus, said roller including means to sense downward contact applied thereagainst by said pipe.

5. The combination of claim 4 wherein said means to sense said position also includes a roller forming the top of said hiatus, said roller including means to sense an upward contact applied thereagainst by said pipe.

6. The combination of claim 3 wherein said means to sense said position comprises a roller forming the top of said hiatus, said roller including means to sense upward contact applied thereagainst by said pipe.

7. The combination of claim 3 wherein said means to facilitate the removal of cuttings comprises a horizontal plate at the top of said arcuate bottom plate and outwardly and rearwardly cutting diverter boards to force said cuttings to both sides of said trench.

8. The combination of claim 3 wherein at least one additional horizontal cutting element exists at said leading edge above said leading edge of said arcuate bottom plate.

9. The combination of claim 3 wherein said plow means is pivoted to said frame and power means actuated by said barge operator to pivot said plow means relative to said frame whereby said plow means may be raised above said bottom of said body of water.

10. The combination of claim 3 wherein said means to sense comprises an underwater video.

11. The combination of claim 3 including a plurality of vertically and rearwardly stepped plow means.

12. In a combination trenching and pipe laying apparatus for laying pipe in the floor of a body of water using a barge;

a frame supported upon parallel skid means for traversing along said floor;

tow wire means connected between said barge and said frame, and means on said barge to adjust the length of said tow wire;

means on said barge to feed and extend said pipe downwardly into bottom of said trench formed by said plow such that said pipe forms an unsupported catenary curve immediately above said frame;

means relative to said framework to sense downward pressure of said pipe against said frame and means to transmit a signal indicative of said pressure to an operator on said barge whereby said operator can maintain said the locus of said pipe above said frame substantially constant by adjusting the length of said tow wire, the improvement characterized by:

a plow means connected to and below said frame for forming a substantially vertical sidewall trench in said bottom, said plow means having a leading forward end and a trailing end and formed of a pair of spaced substantially vertical planar side plates and an arcuate bottom plate curving upwardly and rearwardly to facilitate the removal of cuttings upwardly and outwardly to at least one side of said trench, said leading forward end of said vertical planar side plates and said arcuate bottom plate defining a cutting edge means.

13. The combination of claim 12, the further improvement wherein said means to facilitate the removal of cuttings comprises a horizontal plate at the top of said arcuate bottom plate and outwardly and rearwardly cutting diverter boards to force said cuttings to both sides of said trench.

14. The combination of claim 12, the further improvement wherein at least one additional horizontal cutting element exists at said leading edge above said leading edge of said arcuate bottom plate.

15. The combination of claim 12, the further improvement including a plurality of vertically and rearwardly stepped plow means.

* * * * *